United States Patent [19]

Meicher

[11] Patent Number: 4,887,570

[45] Date of Patent: Dec. 19, 1989

[54] SYSTEM FOR REGULATING THE IDLING SPEED OF ROTATION OF AN INTERNAL COMBUSTION ENGINE

[75] Inventor: Joachim Meicher, Hofheim, Fed. Rep. of Germany

[73] Assignee: VDO Adolf Schindling AG, Frankfurt am Main, Fed. Rep. of Germany

[21] Appl. No.: 163,051

[22] Filed: Mar. 2, 1988

[30] Foreign Application Priority Data

Mar. 19, 1987 [DE] Fed. Rep. of Germany ..... 3708999

[51] Int. Cl.[4] ..... F02M 3/07

[52] U.S. Cl. ..... 123/339; 123/479

[58] Field of Search ..... 123/339, 479, 340

[56] References Cited

U.S. PATENT DOCUMENTS

| | | | |
|---|---|---|---|
| 4,328,547 | 5/1982 | Barman | 364/431.09 |
| 4,344,399 | 8/1982 | Matsumura | 123/339 |
| 4,365,601 | 12/1982 | Yamazoe | 123/339 |
| 4,450,815 | 5/1984 | Mouri | 123/479 |
| 4,491,922 | 1/1985 | Kobayashi | 123/339 |
| 4,531,490 | 7/1985 | Kishi | 123/339 |
| 4,640,244 | 2/1987 | Koike | 123/339 |
| 4,700,675 | 10/1987 | Otobe | 123/339 |
| 4,708,108 | 11/1987 | Sakamoto | 123/479 |
| 4,718,016 | 1/1988 | Sudo | 123/339 |
| 4,748,567 | 5/1988 | Sumizawa | 123/479 |
| 4,760,823 | 8/1988 | Yasuoka | 123/339 |

FOREIGN PATENT DOCUMENTS

| | | | |
|---|---|---|---|
| 0142843 | 6/1987 | Japan | 123/339 |
| 2127585 | 4/1984 | United Kingdom . | |
| 2142171 | 1/1985 | United Kingdom . | |

*Primary Examiner*—Carl S. Miller

*Attorney, Agent, or Firm*—Martin A. Farber

[57] ABSTRACT

In a system for regulating the idling speed of rotation of an internal combustion engine, in which a correction variable, which is determined by comparison of the speed-of-rotation actual value which is fed as speed-of-rotation signal with a speed-of-rotation desired value, is fed to a control member, a predetermined correction variable is fed upon the absence of the speed-of-rotation signal to the control member. Furthermore, it can be provided that a signal (idling signal) which is dependent upon whether the gas pedal is in the idling position is fed, that in the absence of the idling signal the actual speed-of-rotation value is not used for the determination of the correction variable, and that a predetermined correction variable is fed to the control member when the idling signal is not present and the desired speed-of-rotation value is smaller than the actual speed of rotation value for longer than predetermined periods of time and the starting value (opening of the control member upon the starting process) is not greater than the regulating value.

12 Claims, 3 Drawing Sheets

SYSTEM FOR REGULATING THE IDLING SPEED OF ROTATION OF AN INTERNAL COMBUSTION ENGINE

FIELD AND BACKGROUND OF THE INVENTION

The present invention relates to a system for regulating the idling speed of rotation of an internal combustion engine, in which a correction variable, determined by comparison of the actual speed of rotation which is fed as speed-of-rotation signal with a desired speed-of-rotation value, is fed to a control member.

In the known systems for regulating the idling speed of rotation of an internal combustion engine, the control member, which is arranged in a so-called bypass on the throttle valve, is opened wide when the internal combustion engine is cold, in order for a sufficiently high idling speed of rotation to be obtained. With the same opening of the control member one obtains, however, when the engine is hot, a speed of rotation which lies outside of the idling speed-of-rotation range which is permissible based on considerations of safety. If the speed-of-rotation signal drops—due, for instance, to a break in the conduit or a short circuit of the transmitter—then too low a speed of rotation will be simulated, whereupon the regulator opens the control member wide, which leads to too high an idling speed of rotation when the engine is hot.

SUMMARY OF THE INVENTION

It is an object of the present invention to avoid such effects due to the absence of the speed-of-rotation signal.

According to the system of the invention, upon the absence of the speed of rotation signal a predetermined correction variable is fed to the control member.

The predetermined correction variable can be so selected that emergency operation is possible.

In accordance with another development of the invention, it is contemplated that the predetermined correction variable be dependent on the temperature of the internal combustion engine. In this way, the idling speed of rotation can be maintained constant within reasonable limits even in the event of the failure of the speed-of-rotation signal.

One advantageous embodiment of the invention consists therein that the speed-of-rotation signal is formed by speed-of-rotation pulses the repetition rate of which is proportional to the speed of rotation of the internal combustion engine, that a counter to which counting pulses of higher frequency are fed is set back by each of the speed of rotation pulses, and that the predetermined correction variable is fed to the control member upon overflow of the counter.

Upon a transition from idling operation travel operation, the control member is forthwith closed as much as possible due to the increase in the actual speed of rotation which is inherent therein. In this way, when the idling position of the gas pedal is again reached, the internal combustion engine can again reach the stipulated idling speed of rotation only with a delay—or may possibly even stop. Therefore, in known idling speed-of-rotation regulators, upon transition from idling operation to travel operation the operating point of the regulator is stored. For this reason, among others, a so-called idle contact is provided on the gas pedal, which contact gives off an idling signal when the gas pedal is in the idling position.

However, if no idling signal is given off an excessive speed-of-rotation can result which may lie outside of the idling region and thus also lead to dangerous driving situations. This is caused by the start-opening of the regulator which is necessary upon the starting of the engine. The regulator, however, cannot effect a required downward regulation if—as mentioned above—the idling signal is absent. Therefore the object of another system according to the invention is to permit emergency operation in the absence of an idling signal.

The other system of the invention is characterized by the fact that in addition, a signal (idling signal) is fed which is dependent upon whether the gas pedal is in the idling position, that if the idling signal is not present the actual speed-of-rotation value is not used to determine the correction variable, and that a predetermined correction variable is fed to the control member if the idling signal is not present and the desired speed of rotation is greater than the actual speed of rotation for more than a predetermined period of time.

A further development of this system consists therein that the predetermined correction variable is fed to the control member only if, after the predetermined period of time, the actual speed-of-rotation is not less than the predetermined desired speed of rotation upon the start of the internal combustion engine.

Another further development of the invention reduces the effects of the absence of a fed signal which indicates the engine temperature in the manner that a predetermined temperature, is assumed if the signal fed lies outside of a predetermined range.

By the additional features, advantageous further developments and improvements of the invention are possible.

Further, according to the invention, the control member is fed a correction variable the value of which is between a lower control limit and an upper control limit. The control limits are dependent on the signal fed, and predetermined control limits become active when the signal fed lies outside the predetermined range.

Still further, a microcomputer (1) having an analog-to-digital converter (2) is developed as regulator, a temperature-dependent resistor (9) is connected in series, via a line (10), with a resistor (8) arranged in the region of the microcomputer (1), the series connection is acted on by a stabilized voltage which is furthermore fed to the microcomputer (1), and the terminal of the resistor (8) which faces the line (10) is connected to the input of the analog-to-digital converter (2).

Yet further, according to the invention, another resistor (14) is provided between the line (10) and the input of the analog-to-digital converter (2) and the input of the analog-to-digital converter (2) is connected via a diode (15) to the input of the microcomputer for the stabilized voltage.

BRIEF DESCRIPTION OF THE DRAWINGS

With the above and other objects and advantages in view, the present invention will become more clearly understood in connection with the detailed description of preferred embodiments, when considered with the accompanying drawings, of which.

DETAILED DESCRIPTION OF THE PREFERRED EMBODIMENT

Figure 1:
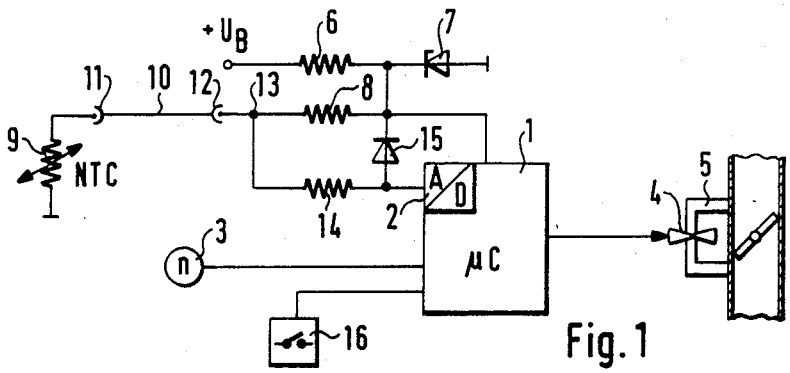
FIG. 1 is a circuit diagram of parts of the system of the invention insofar as they are necessary in order to explain the invention.

The system shown in FIG. 1 comprises a regulator which consists essentially of an integrated circuit which contains a microcomputer 1 as well as an analog-to-digital converter 2. A speed-of-rotation signal—for instance a predetermined number of pulses per revolution of the internal combustion engine—is fed to the regulator by a speed-of-rotation transmitter 3. By comparison with a stored desired value, a control member 4 is controlled, it changing the cross section of a so-called bypass 5. The bypass 5 represents the detour around a throttle valve, shown diagrammatically.

Figure 2:
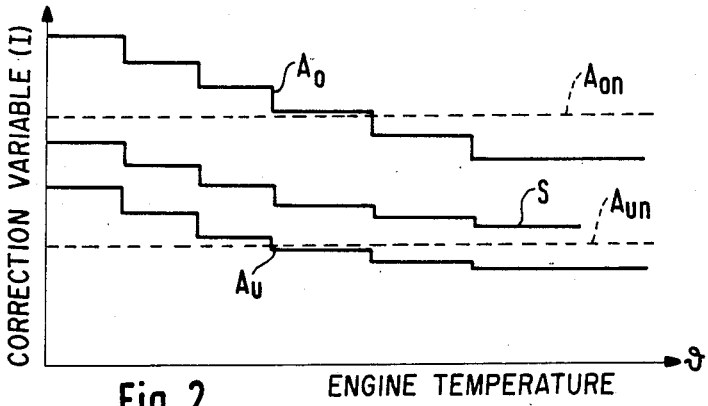
FIG. 2 is a graph of the correction variable as a function of the engine temperature.

Since the amount of air required depends on the temperature of the engine, the control range of the control member 4 is narrowed as a function of the temperature of the engine, as is shown diagrammatically in FIG. 2. In this connection, one upper and one lower control limit $A_o$ and $A_u$ each are provided for the control member 4, said limits decreasing with an increase in the temperature. For each partial range of the temperature, corresponding values are stored in a memory associated with the microcomputer.

Figure 3:
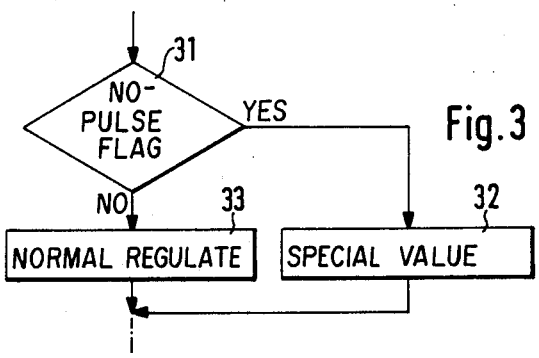
FIG. 3 is a portion of a program of the microcomputer.

If the microcomputer 1 does not receive any speed-of-rotation pulses then the control member 4 is fed a predetermined correction variable which, in accordance with a further feature of the invention, is a function of the temperature of the engine. The corresponding curve is designated S in FIG. 2. One simple possibility for checking the presence of speed-of-rotation pulses will be explained with reference to a flowchart which is shown in FIG. 3. In known manner, within a part of the program not shown in the drawing, a speed-of-rotation measurement is effected by counting pulses of higher frequency between two successive speed-of-rotation pulses. This counter is set back after each speed-of-rotation pulse after its reading has been entered into a register. If now there are no speed-of-rotation pulses, then an overflow takes place if the counter is suitably dimensioned, whereupon a flag is set. In the part of the program shown, it is asked at 31 whether the flag has been set or not. If the flag has been set then the predetermined value for the correction variable is called up at 32. If the flag has not been set then a regulating of the speed of rotation by comparison of the desired and actual speed-of-rotation values takes place in known manner.

Figure 4:
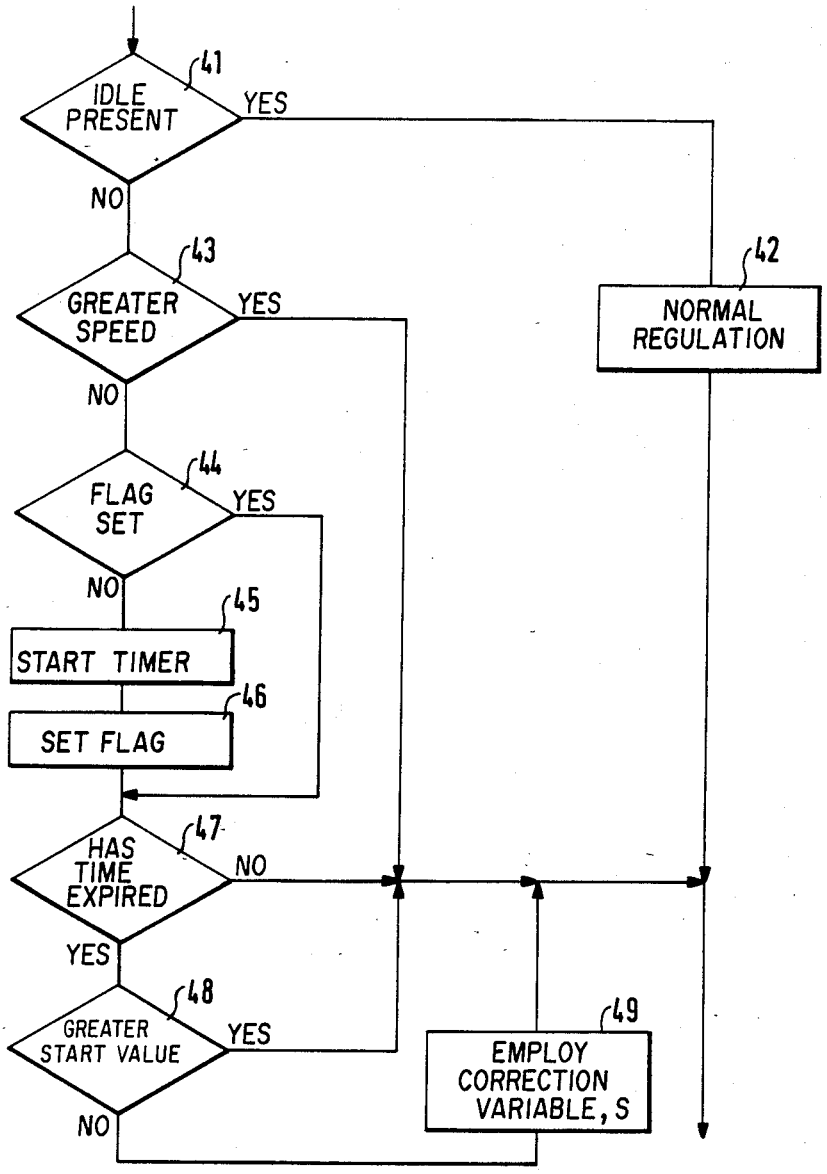
FIG. 4 is a portion of another program of the microcomputer.

In order to be able, upon the regulating of idling speed-of-rotation, to take into consideration whether the gas pedal is in the idling position, an idling switch 16 (FIG. 1) is provided the signal of which, hereinafter called the idling signal, is processed in the microcomputer 1 in the following manner by means of the program shown in FIG. 4.

If it is found at 41 that an idling signal is present, then the idle speed-of-rotation regulation is effected as customary at 42. However, if no idling signal is present, then it is checked whether the desired speed of rotation is greater than the actual speed of rotation. If it is, then the parts 42 of the program which effect a regulating of the speed of rotation are bypassed. In this way, the result is obtained that the speed-of-rotation values which increase by the giving of gas no longer affect the correction variable fed to the control member. However, influence by the temperature is still possible.

If the driver removes his foot from the gas pedal, then the idling switch 16 (FIG. 1) is again closed so that the idling signal is again present and the program part 42 which regulates the speed of rotation is again accessed.

However, should a defect be present so that, despite the return of the gas pedal the idling position, no idling signal results, no regulation of the idling speed of rotation will take place either. This can lead, for instance, to a dangerous driving situation if, as a result of the last-effected regulation of the speed of rotation, the bypass 5 (FIG. 1) was opened very wide and remained in this position during the intermediate giving of gas and then is not adjusted downward again after the giving of gas, due to the absence of the idling signal.

In the case of the defective behavior described, the desired speed of rotation is less than the actual value, which, however, can occur for a short time even in the case of normal operation. The program steps described below therefore check whether a flag is set in the event no idling signal is present and with a desired speed-of-rotation value which is smaller than the actual speed of rotation, inquiry as to this being made at 44. If not, then a predetermined period of time is started at 45 and the flag is set at 46. A decision is then made at 47 whether the predetermined time has expired. If not, this means that the inquiry is avoided at 48. However, if the predetermined period of time has expired then it is tested at 48 whether the start value is greater than the regulating value. In this connection the start value $A_o$ (FIG. 2) and the regulating value correspond to some value between $A_u$ and $A_o$. If so, the program will be continued in normal manner, while otherwise a predetermined correction variable will be called up at 49 and fed to the control member.

A further development of the invention by which incorrect behavior due to a defect within the region of the temperature transmitter and its feed line is prevented will be described below with reference to FIGS. 1 and 5.

In the embodiment shown in FIG. 1, the regulator 1 is fed by an operating voltage (+) which is obtained from the battery voltage $+U_B$ via a resistor 6 and a Z diode 7. The engine temperature is now measured in the manner that the stabilized voltage is fed by a second resistor 8 to an NTC resistor 9. In this connection the NTC resistor 9 is located at a suitable point of the engine while the regulator, including the few discrete elements shown in FIG. 1, is located in a corresponding housing. The connection between the NTC resistor 9 and the regulator circuit takes place via a line 10 which is provided with plug devices 11, 12 on both ends.

The circuit point 13 represents the input for the temperature signal and is connected via a resistor 14 to the input of the analog-to-digital converter 2. The value of the voltage fed to the analog-to-digital converter depends accordingly on the value of the NTC resistor 9 and thus on the temperature of the engine.

In the event of a short circuit in the region of the NTC resistor 9 or of a grounding of the signal line 10, the voltage at the input 13 assumes ground potential, which is detected in the microcomputer, whereupon the control limits $A_{on}$ and $A_{un}$ shown in dashed line in FIG. 2 are established. Upon an interruption of the signal line 10, the voltage at the input 13 becomes equal to the positive operating voltage (+) of the microcomputer, which also leads to an application of the predetermined control limits. The same is true for a short circuiting of the signal line with a line which carries a higher voltage, for instance the operating voltage $+U_B$. A resistor 14 and a diode 15 are provided for this case. The diode then becomes conductive and thus prevents the input voltage of the analog-to-digital converter from increasing substantially above the operating voltage of the microcomputer or of the analog-to-digital converter.

Figure 5:
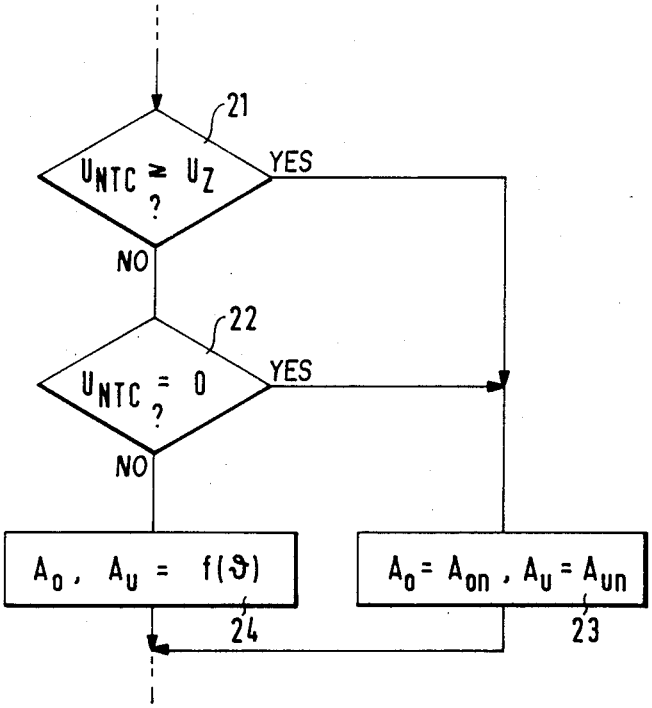
FIG. 5 is another portion of the program.

FIG. 5 shows, as flowchart, parts of a program which serve for checking the input signal $U_{NTC}$ of the analog-to-digital converter 2 and for shifting to so-called emergency operation. First of all, it is noted at 21 whether $U_{NTC}$ is greater than or equal to $U_Z$. If so, then the control limits $A_o$ and $A_u$ are set at 23 equal to the values $A_{on}$ and $A_{un}$ predetermined for emergency operation. If $U_{NTC}$ is smaller than $U_Z$ then it is checked at 22 whether $U_{NTC}=0$ (ground). If so, the program is also continued at 23. However, if $U_{NTC}$ is greater than 0, then the determination of the control limits $A_o$ and $A_u$ takes place at 24 as a function of the temperature.

With respect to terminology used herein, the Z diode 7 is a zener diode. The NTC resistor 9 has a negative temperature coefficient of resistance.

A housing for the regulator may be located distant from the engine. In FIG. 2, the vertical axis represents the values of a coefficient variable (current) fed to the controlling element 4 by the regulator. The horizontal axis in FIG. 2 represents engine temperature as applied by the voltage of the analog-to-digital converter from increasing substantially above the operating voltage of the microcomputer or of the analog-to-digital converter.

Legends of Figures

FIG. 2

| | |
|---|---|
| x axis | engine temperature |
| y axis | correction variable (current) |

FIG. 3

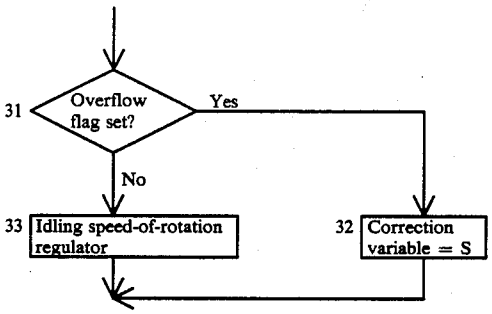

FIG. 4

| | | | | |
|---|---|---|---|---|
| 41 | Idling signal present? | Yes | | |
| | | No | 42 | Idling speed of rotation regulator |
| 43 | Desired value ≧ actual value? | Yes | | |
| | | No | | |
| 44 | Flag set? | Yes | | |
| | | No | | |
| 45 | Start of predetermined time | | | |
| 46 | Set flag | | | |
| 47 | Is predetermined time still on? | Yes | | |
| | | No | | |
| 48 | Starting Value > Regulating Value | Yes | | |
| | | No | 49 | Correcting variable = S |

-continued

Legends of Figures

FIG. 5

| | | |
|---|---|---|
| 21 | UNTC ≧ Uz? | Yes |
| | | No |
| 22 | UNTC = 0? | Yes |
| | | No |

I claim:

1. A system for regulating the idling speed of rotation of an internal combustion engine, comprising regulator means for applying a correction variable to a control element of the engine, said regulator means including means for comparing a signal representing an actual rotational speed with desired rotational speed; the correction variable, determined by comparison of the actual rotational speed signal with a desired rotational speed value, being applied to the control element; and wherein an idling signal is inputted to said regulator means dependent upon whether the gas pedal is in the idling position;

said comparison means is disabled by an absence of the idling signal;

a predetermined correction variable is fed by the regulator means to the control element during absence of the idling signal and during a condition wherein the desired speed of rotation is smaller than the actual speed of rotation for more than a predetermined period of time;

said regulating means applies the predetermined correction variable to the control element only if, after the predetermined period of time, the actual speed-of-rotation is greater than the predetermined desired speed of rotation upon a start of the internal combustion engine;

a further signal is evaluated, which signal indicates the engine temperature, a predetermined temperature being assumed if the temperature signal lies outside of a predetermined range.

2. The system for regulating the idling speed of rotation of an internal combustion engine, according to claim 1, wherein upon the absence of the actual rotational speed signal, said regulator means applies a predetermined correction variable to the control element.

3. A system according to claim 2, wherein the predetermined correction variable is dependent on the temperature of the internal combustion engine.

4. A system according to claim 3, further comprising a counter; and wherein the rotational speed signal is formed by speed-of-rotation pulses from the engine, the repetition rate of which pulses is proportional to the speed of rotation of the internal combustion engine;

said counter counts pulses of higher frequency than a repetition frequency of the speed pulses, and is set back by each of the speed pulses; and the predetermined correction variable is applied to the control element upon overflow of the counter.

5. A system according to claim 2, further comprising a counter; and wherein the rotational speed signal is formed by speed-of-rotation pulses from the engine, the repetition rate of which pulses is proportional to the speed of rotation of the internal combustion engine;

said counter counts pulses of higher frequency than a repetition frequency of the speed pulses, and is set back by each of the speed pulses; and the predetermined correction variable is applied to the control element upon overflow of the counter.

6. A system for regulating the idling speed of rotation of an internal combustion engine, comprising regulator means for applying a correction variable to a control element of the engine, said regulator means including means for comparing a signal representing an actual rotational speed with desired rotational speed; the correction variable, determined by comparison of the actual rotational speed signal with a desired rotational speed value, being applied to the control element; and wherein an idling signal is inputted to said regulator means dependent upon whether the gas pedal is in the idling position;

said comparison means is disabled by an absence of the idling signal;

a predetermined correction variable is fed by the regulator means to the control element during absence of the idling signal and during a condition wherein the desired speed of rotation is smaller than the actual speed of rotation for more than a predetermined period of time;

a further signal is evaluated, which signal indicates the engine temperature, a predetermined temperature being assumed if the temperature signal lies outside of a predetermined range.

7. A system according to claim 6, wherein said regulating means applies the predetermined correction variable to the control element only if, after the predetermined period of time, the actual speed-of-rotation is greater than the predetermined desired speed of rotation upon a start of the internal combustion engine.

8. A system according to claim 1, wherein the control element is fed a correction variable the value of which is between a lower control limit and an upper control limit; and the control limits are dependent on the temperature signal, and predetermined control limits become active for values of temperature signal lying outside the predetermined range.

9. A system according to claim 8, wherein the regulator means comprises a microcomputer and an analog-to-digital converter, the system including a series connection of a temperature-dependent resistor and a fixed resistor connected in series via a line, the fixed resistor being located at the microcomputer;

a voltage source applying to the series connection a stabilized voltage which is furthermore fed to the microcomputer; and wherein a terminal of the fixed resistor faces the line and is connected to the input of the analog-to-digital converter.

10. A system according to claim 1, wherein the regulator means comprises a microcomputer and an analog-to-digital converter, the system including a series connection of a temperature-dependent resistor and a fixed resistor connected in series via a line, the fixed resistor being located at the microcomputer;

a voltage source applying to the series connection a stabilized voltage which is furthermore fed to the microcomputer; and wherein a terminal of the fixed resistor faces the line and is connected to the input of the analog-to-digital converter.

11. A system according to claim 9, further comprising a diode and a further resistor connected between said line and the input of the analog-to-digital converter; and wherein the input of the analog-to-digital converter is connected via said diode to an input of the microcomputer receiving the stabilized voltage.

12. A system according to claim 8, further comprising a diode and a further resistor connected between said line and the input of the analog-to-digital converter; and wherein the input of the analog-to-digital converter is connected via said diode to an input of the microcomputer receiving the stabilized voltage.

* * * * *